US006716329B2

(12) United States Patent
Okase et al.

(10) Patent No.: US 6,716,329 B2
(45) Date of Patent: Apr. 6, 2004

(54) PROCESSING APPARATUS AND PROCESSING SYSTEM

(75) Inventors: Wataru Okase, Kanagawa (JP); Takenobu Matsuo, Kanagawa (JP)

(73) Assignee: Tokyo Electron Limited, Tokyo (JP)

( * ) Notice: Subject to any disclaimer, the term of this patent is extended or adjusted under 35 U.S.C. 154(b) by 324 days.

(21) Appl. No.: 09/846,660

(22) Filed: May 1, 2001

(65) Prior Publication Data

US 2001/0040098 A1 Nov. 15, 2001

(30) Foreign Application Priority Data

May 2, 2000 (JP) ..... 2000-133454
May 8, 2000 (JP) ..... 2000-135207
May 8, 2000 (JP) ..... 2000-135227

(51) Int. Cl.[7] ..... C25D 21/12; C25D 5/00

(52) U.S. Cl. ..... 205/81; 205/84; 134/84

(58) Field of Search ..... 205/81, 84; 204/228.7, 204/229.8, 229.9, 230.1; 134/84

(56) References Cited

U.S. PATENT DOCUMENTS 6,193,859 B1 * 2/2001 Contolini et al. ..... 204/224 R
6,352,623 B1 * 3/2002 Volodarsky et al. ..... 204/275.1
6,432,282 B1 * 8/2002 Shamouilian et al. .... 204/228.1
6,444,101 B1 * 9/2002 Stevens et al. ..... 204/224 R
6,500,317 B1 * 12/2002 Yoshioka et al. ..... 204/228.7
6,517,689 B1 * 2/2003 Hongo et al. ..... 204/228.7

FOREIGN PATENT DOCUMENTS

JP 05320977 A * 12/1993
JP 11-154653 6/1999
JP 11-181600 7/1999
JP 11-307481 11/1999

* cited by examiner

*Primary Examiner*—Wesley A. Nicolas
(74) *Attorney, Agent, or Firm*—Crowell & Moring LLP

(57) ABSTRACT

A plating system is composed of a transfer device for performing transfer of a wafer, a plating unit and a washing/drying unit provided around the transfer device. Each unit is structured to be detachable from the plating system. The plating unit is divided into a wafer transfer section and a plating section by a separator, and atmosphere of each section is independently set.

7 Claims, 14 Drawing Sheets

PROCESSING APPARATUS AND PROCESSING SYSTEM

BACKGROUND OF THE INVENTION

1 Field of the Invention

The present invention relates to a processing apparatus and a processing system.

2 Description of the Related Art

In recent years, attention has been given to copper as wiring material of a semiconductor apparatus. A method for forming a copper wiring includes sputtering, chemical vapor deposition (CVD), electric filed plating, and the like. Among these method, attention is particularly paid to a wiring technique using the electric filed plating. In the method for forming a buried wiring using the electric field plating, a barrier metal layer is formed on a groove or a connection hole, thereafter a copper-made seed layer is filmed by sputtering or CVD, and sequentially a wiring layer is formed by electric filed plating. The electric field plating makes it possible to bury copper in the groove or connection hole with a high aspect ratio at room temperature.

A plating apparatus that forms a copper wiring in a semiconductor wafer by electric field plating is disclosed in, for example, Unexamined Japanese Patent Application KOKAI Publication No. H11-154653. The plating apparatus disclosed in this publication comprises a load/unload area where delivery for a cassette containing a substrate is performed, a plating process area where plating process is performed, and a washing and drying area where washing and drying are performed to the substrate subjected to plating process. An air supply and exhaust and pressure control are performed to the washing and drying area and the plating process area independently of each other.

Moreover, a plating apparatus disclosed in Unexamined Japanese Patent Application KOKAI Publication No. H11-307481 has the structure, which is so-called multi-chamber system. More specifically, a wafer containing section for loading, a pre-treatment chamber, a plating chamber, a post-treatment chamber, and an wafer containing section for unloading are connected to one another through, e.g., a gate valve around a transfer chamber where a transfer robot for transferring a wafer is provided.

The plating apparatus disclosed in Unexamined Japanese Patent Application KOKAI Publication No. H11-154653, however, performs control of atmosphere for each area. For this reason, particles and chemical mist can be prevented from being scattered between these areas, but prevention particles and chemical mist cannot be prevented from being scattered between the respective plating baths provided in the plating area. Particularly, in the case where process is performed under a condition, which is different depending on each plating bath, for example, the use of a different plating solution, it is impossible to prevent particles and chemical mist from being scattered between the respective plating baths.

In the typical plating apparatus, since plating is performed using plating solution, mist is generated. For this reason, even if atmosphere in the plating bath is controlled with high accuracy, there is a possibility that mist will exist in the plating bath. Accordingly, the plating apparatus is desirably maintained out of a clean room where the plating apparatus is provided.

However, since the plating bath, and the washing and drying tank provided in the plating apparatus are not structured to be easily attachable/detachable and movable, it is not easy to move the plating bath out of the clean room to perform maintenance. Similarly, it is not easy to increase and decrease the number of plating baths and washing and drying tanks.

In the plating apparatus disclosed in Unexamined Japanese Patent Application KOKAI Publication No. H11-307481, atmosphere in the plating chamber having the plating bath therein is only controlled to nonoxide atmosphere, and control of mist in the plating chamber is not particularly performed. For this reason, in the aforementioned plating apparatus, if the gate valve is opened to release the airtight state of the plating chamber during wafer transferring, the mist in the plating chamber is scattered out of the plating chamber. Thus, in the conventional plating apparatus, there was a possibility that contamination caused by mist of plating solution was not sufficiently prevented, with the result that plating with high reliability was not performed.

Moreover, in the aforementioned plating apparatus, a processing object, for example, a semiconductor wafer is applied given voltage through a plurality of contact pins provided in a holding member for holding the processing object. Accordingly, there is a problem in which a nonuniform film is formed on the processing object or no plating is performed when electrical contact of contact pins to the processing object is poor.

As a method for checking the contact state of contact pins to the processing object, there is a method disclosed in Unexamined Japanese Patent Application KOKAI Publication No. H11-181600. This is the method in which a resistance value between two contact pins connected to each other is measured by a resistance measuring device to confirm the contact state of contact pins from the resistance values.

The above method, however, is to confirm the contact state of the contact pins interposed between two contact pins. Accordingly, it is impossible to know which contact pin has contact failure. In order to check the contact state of each contact pin in detail, numerous resistance measuring devices must be used, and this makes the apparatus structure complicated. Thus, there was a possibility that the conventional plating apparatus did not confirm the passage of electric current through the processing object and the contact pins with ease and without fail, resulting that plating with high reliability was not performed.

SUMMARY OF THE INVENTION

With consideration given to the aforementioned problems, it is an object of the present invention to provide a processing apparatus and a processing system with high reliability.

Other object of the present invention is to provide a processing apparatus and a processing system with easy maintenance.

Another object of the present invention is to provide a processing apparatus and a processing system, which is capable of easy and sure checking of electrical contact state.

In order to attain the above objects, according to the present invention, there is provided a processing apparatus comprising a chamber having a first area for performing a delivery of a processing object between an outer section and the chamber, and a second area for providing given processing to the processing object; a process solution bath, provided in the second area, for reserving a process solution; a processing mechanism for providing predetermined processing to the processing object using the process solution in the second area; a sucking line, provided in the first area, for sucking atmosphere of the first area in the vicinity of a boundary between the first area and the second area; and an exhaust line, provided in the second area, for exhausting atmosphere in the second area to the outer section in the vicinity of the boundary between the first area and the second area.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

First Embodiment

A processing apparatus according to the first embodiment will be specifically explained with reference to the drawings accompanying herewith. The processing apparatus according to the first embodiment is a plating apparatus that provides plating to a semiconductor wafer.

Figure 1:
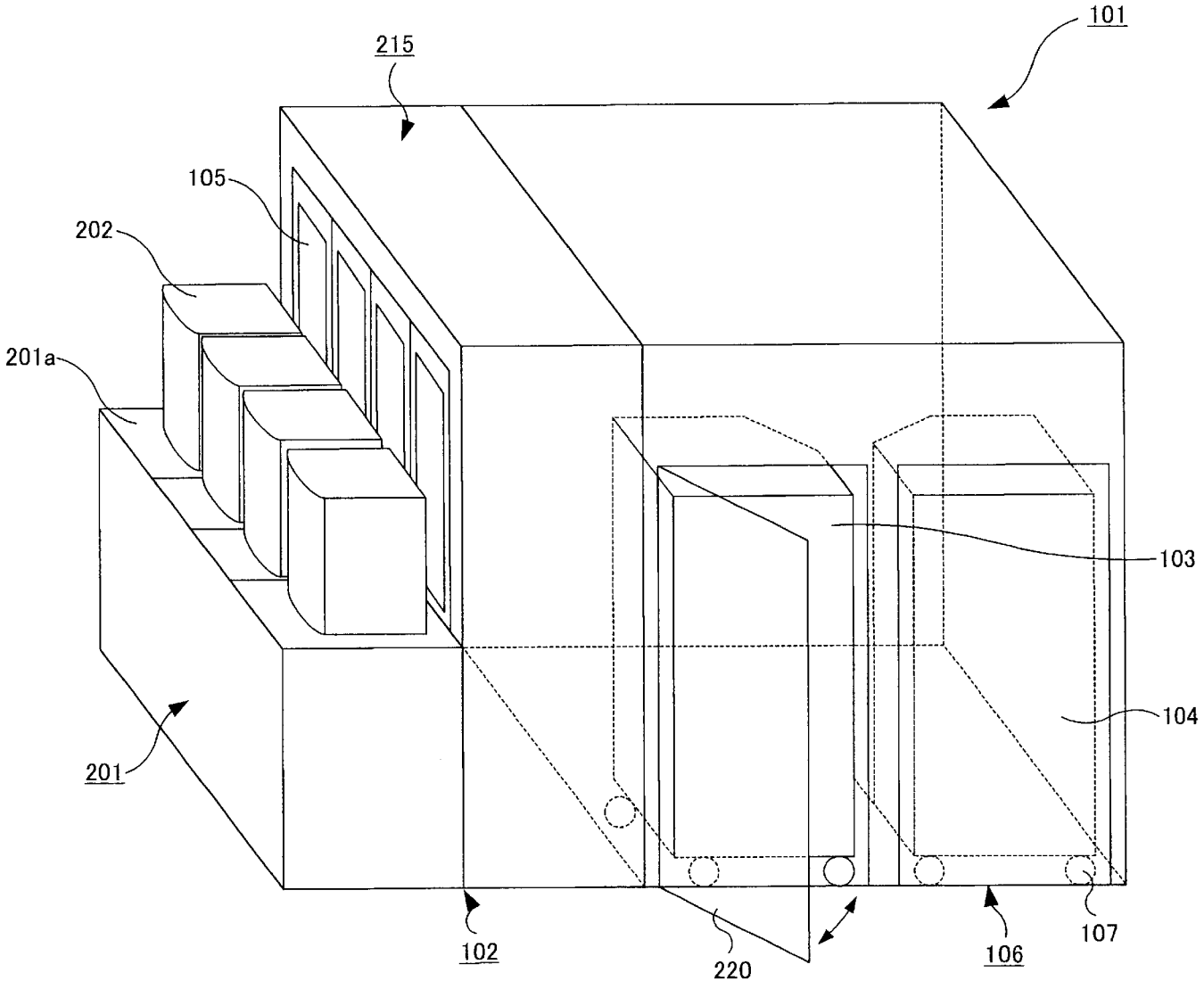
FIG. 1 illustrates a perspective view of a plating process system according to a first embodiment.
Figure 2:
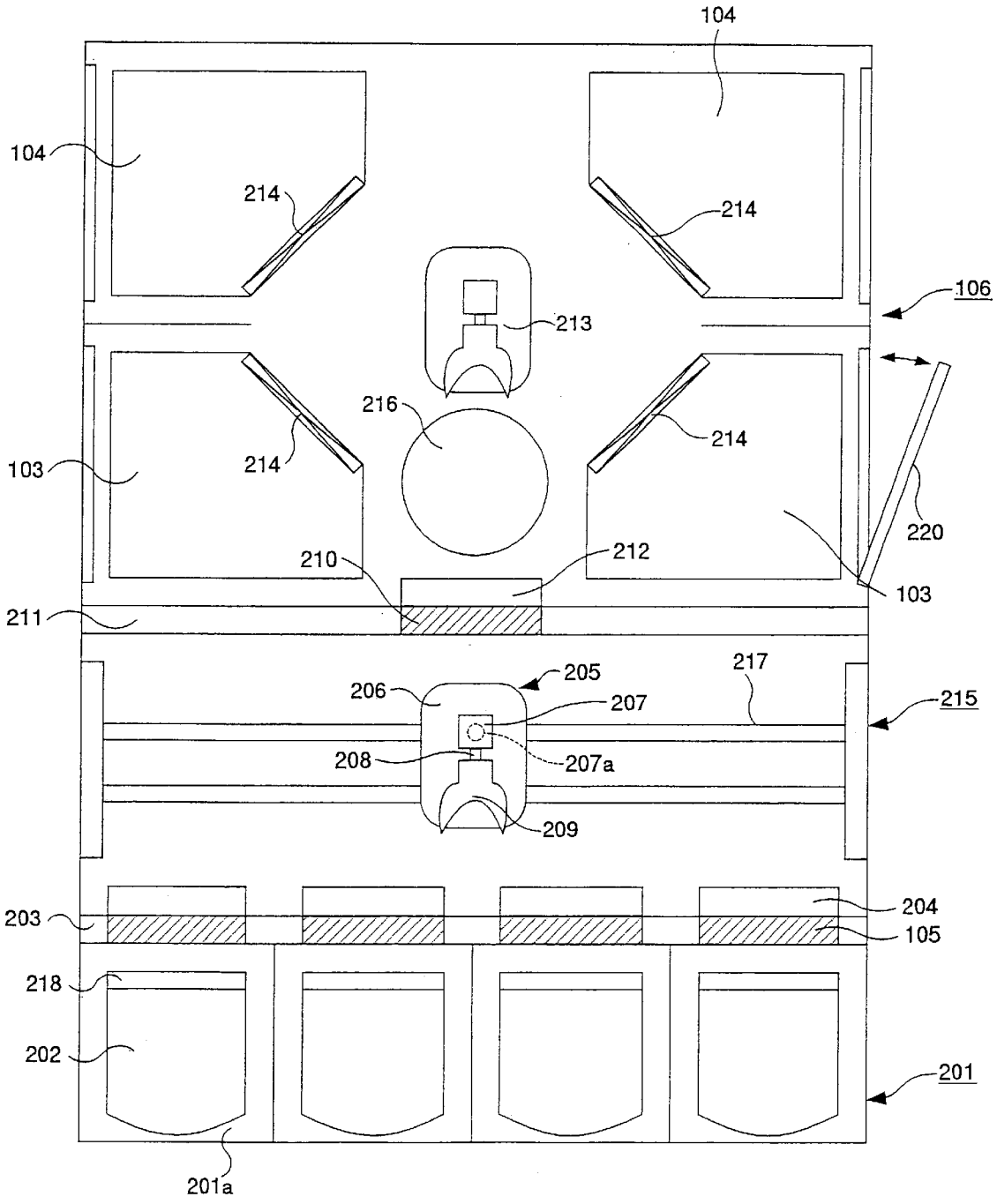
FIG. 2 illustrates a plane view of the plating process system according to the first embodiment.

FIG. 1 is a perspective view of a plating system 101 according to the first embodiment, and FIG. 2 is a plane view of the plating system 101.

As illustrated in FIGS. 1 and 2, the plating system 101 is composed of a cassette station 102 and a process station 106. The cassette station 102 has a cassette stage 201 for mounting cassettes thereon, and a transfer stage 215 for transferring a wafer. The cassette station 102 and the transfer stage 215 are divided by a first wall 203.

The cassette stage 201 has a cassette loading table 201*a* on which a plurality of cassettes 202, e.g., up to four cassettes, can be loaded. The cassette 202 can contain a plurality of wafers, for example, 25 wafers. Each cassette 202 has an opening with a cover 218 for extracting/containing a wafer.

The cassette loading table 201*a* is structured to be movable in the direction of the first wall 203 by a cassette drive mechanism. The first wall 203 has a first opening 105 with substantially the same area as that of the opening of the cassette 202 at the position opposite to the opening of the cassette 202. The wafer is extracted and contained from/to the cassette 202 through the first opening 105. In the case where the cassette 202 is not loaded thereon, the first opening 105 is closed by a first shutter member 204 for interrupting the atmosphere of the cassette stage 201 and that of the transfer stage 215. The first shutter member 204 is movable up and down, and the opening/closing of the first opening 105 is carried out by the ascent and descent of the first shutter member 204.

As illustrated in FIG. 2, rails 217 provided in parallel to the cassette stage 201 and a first wafer transfer apparatus 205 provided on the rails 217 are mounted on the transfer stage 215. The first wafer transfer apparatus 205 comprises a transfer apparatus main body 206, a transfer arm support table 207 provided on the transfer apparatus main body 206, a support shaft 207*a*, a transfer arm 209, and a transfer arm support shaft 208. The support shaft 207*a* supports the transfer arm support table 207 rotatably, the transfer arm 209 holds a wafer, and the transfer arm support shaft 208 supports the transfer arm 209 rotatably.

The transfer apparatus main body 206 is movable on the rails 217 by the drive mechanism. The transfer arm support table 207 is connected to the transfer apparatus main body 206 through the support shaft 207*a*, and turns around the support shaft 207*a* in accordance with the rotation of the support shaft 207*a*. The transfer arm 209 is connected to the support table 207 through the transfer arm support shaft 208 to rotate the transfer arm support shaft 208. At this time, the transfer arm 209 turns around the transfer arm support shaft 208. Namely, the transfer arm 209 is structured to be rotatable around the transfer arm support shaft 208 while holding the wafer thereon.

The support shaft 207*a* and transfer arm support shaft 208 each is structured to be extendable in an axial direction. When the support shaft 207*a* extends, the transfer arm support table 207 moves in accordance with the support shaft 207*a*. Accordingly, the transfer arm 209 is movable in all directions, and makes it possible to transfer the wafer to a given position.

The process station 106 has a second wafer transfer apparatus 213 with the functions equivalent to the first wafer transfer apparatus 205 (excepting the function of moving on the rails) at the center. Around the second wafer transfer apparatus 213, a buffer 216, plating units 104, and washing/drying units 103 are arranged. The buffer 216 can contain the wafer temporarily, the plating unit 104 provides plating to the wafer, and the washing/drying unit 103 washes and dries the wafer subjected to plating. Each of the plating unit 104 and the washing/drying unit 103 is airtightly structured and has the gate valve 214 for loading/unloading the wafer.

A second wall 211 is formed between the transfer stage 215 and the process station 106. Moreover, the second wall 211 has a second opening 210, and a second shutter member 212, which is openable and closeable, is fixed to the second opening 210. In the case where the load/unload of wafer is not performed between the transfer stage 215 and the process station 106, the second shutter member 212 is closed and interrupts the atmosphere of the transfer stage 215 and that of the process station 106.

An openable and closeable door 220 is formed at the part of the wall of the process station 106. Each of the plating unit 104 and the washing/drying unit 103 has a movable mechanism, for example, a caster. Accordingly, the plating unit 104 and the washing/drying unit 103 are movable to the interior or exterior of the process station 106 through the door 220, respectively. This structures the plating unit 104 and the washing/drying unit 103 to be easily attachable/detachable to/from the process station 106.

Thus, the plating unit 104 and the washing/drying unit 103 are structured to be attachable/detachable to/from the process station 106, making it easy to install the plating unit 104 and the washing/drying unit 103 to the process station 106. At the time of performing maintenance of the plating unit 104, the plating unit 104 is moved to the outside of the clean room, where no problem occurs even if the mist flows. Moreover, an increase and decrease in the number of plating units 104 and washing/drying units 103 provided in the plating system 101 can be easily carried out.

Even when the unit necessary for maintenance is extracted from the plating system 101, the unit is replaced with a preliminary unit, making it possible to carry out the process continuously without reducing the throughput.

Instead of providing the moving mechanism at each unit, the plating unit 104 and the washing/drying unit 103 may be lifted up from above by a crane to be moved into the process station 106. Or, they may be moved by a transfer jig such as a cart and the like.

Additionally, not only the entirety of the plating unit 104 or the washing/drying unit 103 but also the part of each unit may be attachable and detachable. For example, in the case of the plating unit 104, the moving mechanism such as a caster is provided to a plating bath section 302 illustrated in FIG. 3, making it possible to attach/detach only the plating bath section 302.

Figure 3:
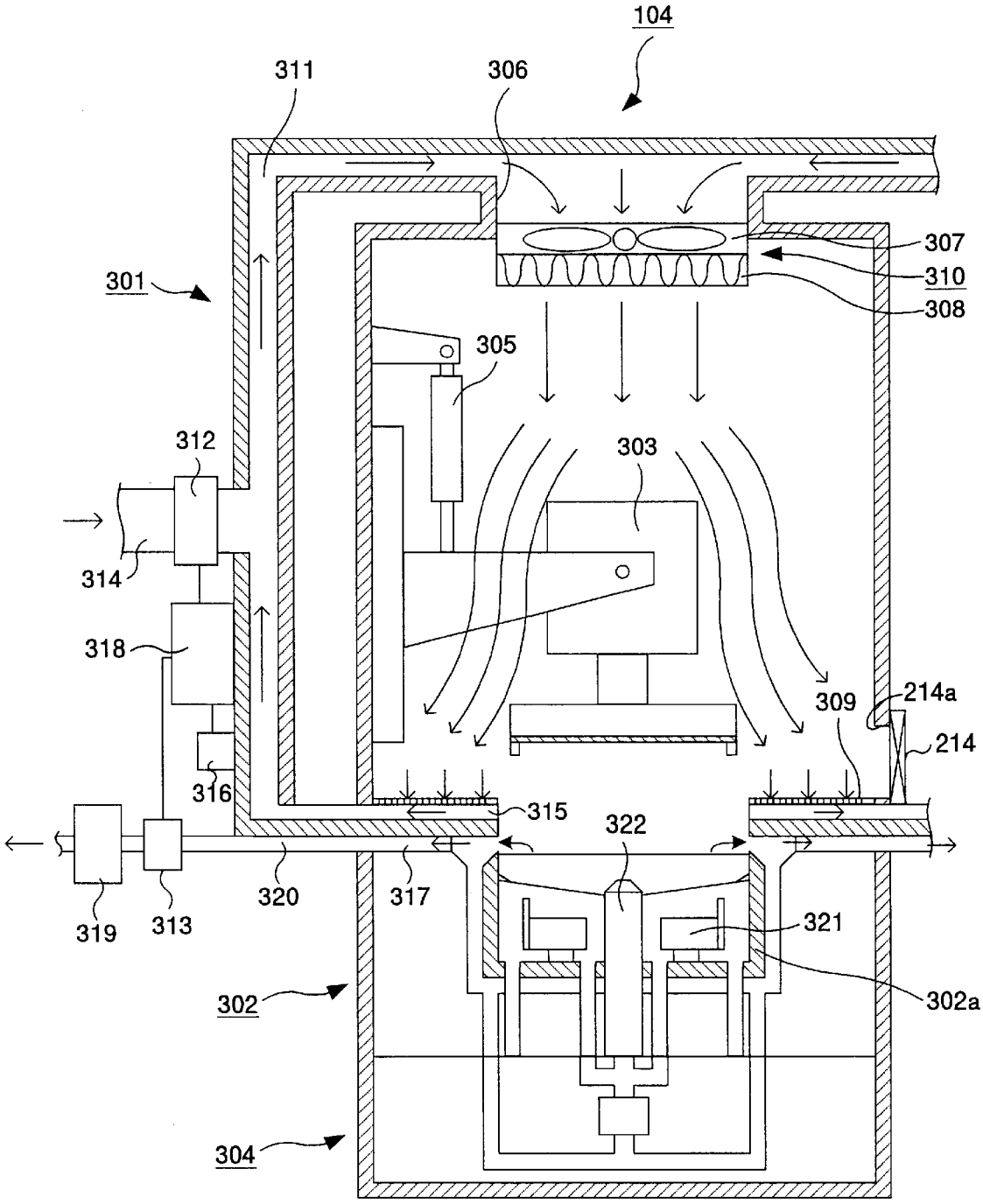
FIG. 3 illustrates the structure of a plating apparatus according to the first embodiment.

An explanation will be next given of the structure and function of the plating unit 104 with reference to FIG. 3. The plating unit 104 is divided into two areas, that is, a wafer transfer section 301 where the transfer of wafer is performed and a plating bath section 302 where plating is provided to the wafer.

The plating bath section 302 has a plating bath 302*a*. A plating solution such as copper sulfate and the like is contained in the plating bath 302*a*. In the plating bath 302*a*, an anode electrode 321, made of copper, is provided, and it is connected to a positive polarity of a power source. At the lower section of the plating bath 302*a*, a plating solution circulation system for circulating the plating solution is provided. The plating solution is injected upwardly from a nozzle section 322 by the plating solution circulation system.

In the wafer transfer section 301, a wafer holding member 303 is provided. The wafer holding member 303 has an up and down drive mechanism 305 to be movable up and down. The wafer holding member 303 has a cathode electrode, the cathode electrode is connected to the back face of the platen surface of the wafer and is connected to a negative polarity of the power source.

An air supply port 306 is formed at the upper portion of the wafer transfer section 301, and a first exhaust port 315 is formed at the bottom portion thereof. The air supply opening 306 and the fist exhaust port 315 are connected to each other through a circulation pipeline 311. The air supply opening 306 is also connected to the wafer transfer section 301 through an air supply chamber 310.

The air supply chamber 310 has an air blower 307 such as a blower fan. At the exhaust side of the blower 307, there is provided an air cleaning device 308 such as a chemical filter for removing organic contaminant, a filter for preventing dust, e.g., ULPA and the like.

A porous plate 309 is provided on the upper surface of the first exhaust port 315. The porous plate 309 has numerous holes that function as an exhaust port. An outer air introduction pipe 314 is formed between the air supply opening 306 and the first exhaust port 315 provided in the circulation pipeline 311. The outer air introduction pipe 314 has a flow controller 312, such as a damper, flow rate control valve, and the like.

In the vicinity of the first exhaust port 315, a gate 214*a* for loading/unloading the wafer and a gate valve 214 are provided.

A second exhaust port 317 is provided in the vicinity of the solution level of the plating solution of the plating bath section 302. The second exhaust port 317 is connected to an exhausting device such as a pump through an exhaust pipeline 320. Mist generated from the plating solution of the plating bath section 302 is exhausted through the exhaust pipeline 320 from the second exhaust port 317.

It is noted that the placement of the second exhaust port 317 is not limited to the level close to the solution level of the plating solution, and any position may be possible if the contaminant such as mist generated from the plating bath 302 can be sufficiently absorbable.

The exhaust pipeline 320 is connected to a removing device 319 through a pressure regulator 313 such as a slit damper, a pressure control valve, and the like. The removing device 319 comprises a mist catcher for removing mist in the air, a scriber for washing and removing contaminants. The removing device 319 dissolves the mist flowing in the exhaust pipeline 320 in water to collect the mist. Thus, dissolving the mist in water makes it possible to remove the mist efficiently.

Down flow of clean air is formed in the wafer transfer section 301 by the air blower 307. The clean air is exhausted from the first exhaust port 315 and the porous plate 309, which are provided at the lower portion of the wafer transfer section 301. The exhausted clean air is returned to the air supply opening 306 provided at the upper portion of the wafer transfer section 301 through the circulation pipeline 311. The circulated clean air is supplied to the wafer transfer section 301 again through the air supply chamber 310. Here, the circulating clean air is purified by the air-cleaning device 308 provided in the air supply chamber 310.

The flow controller 312 and the pressure regulator 313 are controlled by a controller 318 such as a central processing unit (CPU) and the like. Here, the plating unit 104 has a pressure detector 316 connected to the controller 318. The pressure detector 316 detects pressure of the interior of the plating unit 104, pressure of the exterior thereof, and a pressure difference between the interior and the exterior of the plating unit 104.

The controller 318 obtains pressure data from the pressure detector 316, and controls the flow controller 312 and the pressure regulator 313 based on the obtained pressure data and data stored beforehand. In this way, the controller 318 controls the pressure of the interior of the plating unit 104 to a given pressure and controls the quantity of clean air to be supplied to a given value.

For example, the controller 318 controls the flow controller 312 to introduce clean air of the clean room into the circulation pipeline 311 from the outer air introduction pipe 314 and to maintain the flow rate of clean air of the plating unit 104 constant. The controller 318 also controls the pressure regulator 313 to maintain the pressure of the interior of the plating unit 104 lower than the pressure of the exterior thereof. This prevents atmosphere of the plating unit 104 from being leaked outside when the gate valve 214 is opened or closed.

According to the aforementioned structure, the contaminants such as mist contained in the atmosphere in the plating bath section 302 are absorbed by the second exhaust port 317 and discharged while being exhausted. This prevents the outflow of the contaminants such as mist to the wafer transfer section 301. Moreover, the down flow of clean air is formed in the wafer transfer section 301, and this further prevents contamination generated from the plating bath section 302. Accordingly, it is possible to control the wafer transfer section 301 and the plating bath section 302 to two atmospheres each having substantially different cleanliness.

The following will explain the wafer process steps in the plating unit 104 with reference to FIGS. 2 and 3.

First, the cassette 202 is loaded on the cassette loading table 201*a*. The cassette loading table 201*a* moves in the direction of the first opening 105 of the first wall 203 by the cassette drive mechanism. After that, the cover 218 of the cassette 202 is detached by a lock mechanism of the first shutter member 204 of the first opening 105. The first shutter member 204 moves down thereafter, and the delivery of wafer is performed in this state.

Sequentially, the first wafer transfer apparatus 205 of the transfer stage 215 moves on the rails 217 and comes close to the second opening 210 of the second wall 211. Moreover, in a state that the second shutter member 212 of the second opening 210 is opened, the first wafer transfer apparatus 205 moves to the buffer 216 of the process station 106 to load the wafer on the buffer 216. After that, the second shutter member 212 of the second opening 210 is closed.

The wafer loaded on the buffer 216 is carried into the plating unit 104 through the gate valve 214 by the second wafer transfer apparatus 213 placed at the center of the process station 106. The wafer is held by the wafer holding member 303 and is moved down to be dipped in the plating solution. After that, the negative potential is applied to the cathode electrode, while the positive potential is applied to the anode electrode 321. In this way, copper is eluted as a copper ion and adhered onto the wafer surface as a cathode, whereby the wafer is plated.

After that, the second transfer apparatus 213 extracts the wafer subjected to plating from the plating unit 104 through the gate valve 214, and loads the wafer onto the washing/drying unit 103 through the gage valve 214. At the washing/drying unit 103, the wafer is subjected to the washing/drying process.

The wafer subjected to the washing/drying process is transferred to the cassette 202 by reversing the operation in which the wafer is transferred to the process station 106. When the process of all wafers in the cassette 202 is completed, the first shutter member 204 that holds the cover 218 rises by the shutter member elevation mechanism and moves to the opening of the cassette 202 so that the cover 218 is attached to the cassette 202. When the cover 218 is attached to the cassette 202, the cassette loading table 201*a* is retreated by the drive mechanism and moved to the cassette taking-up position. A series of wafer processes is thus executed.

At the time of performing the maintenance of the plating unit 104 and the washing/drying unit 103 or the replacement (including replacement parts), a step in which the aforementioned process is provided to a dummy wafer before an actual process to stabilize the respective process conditions may be carried out.

Figure 4:
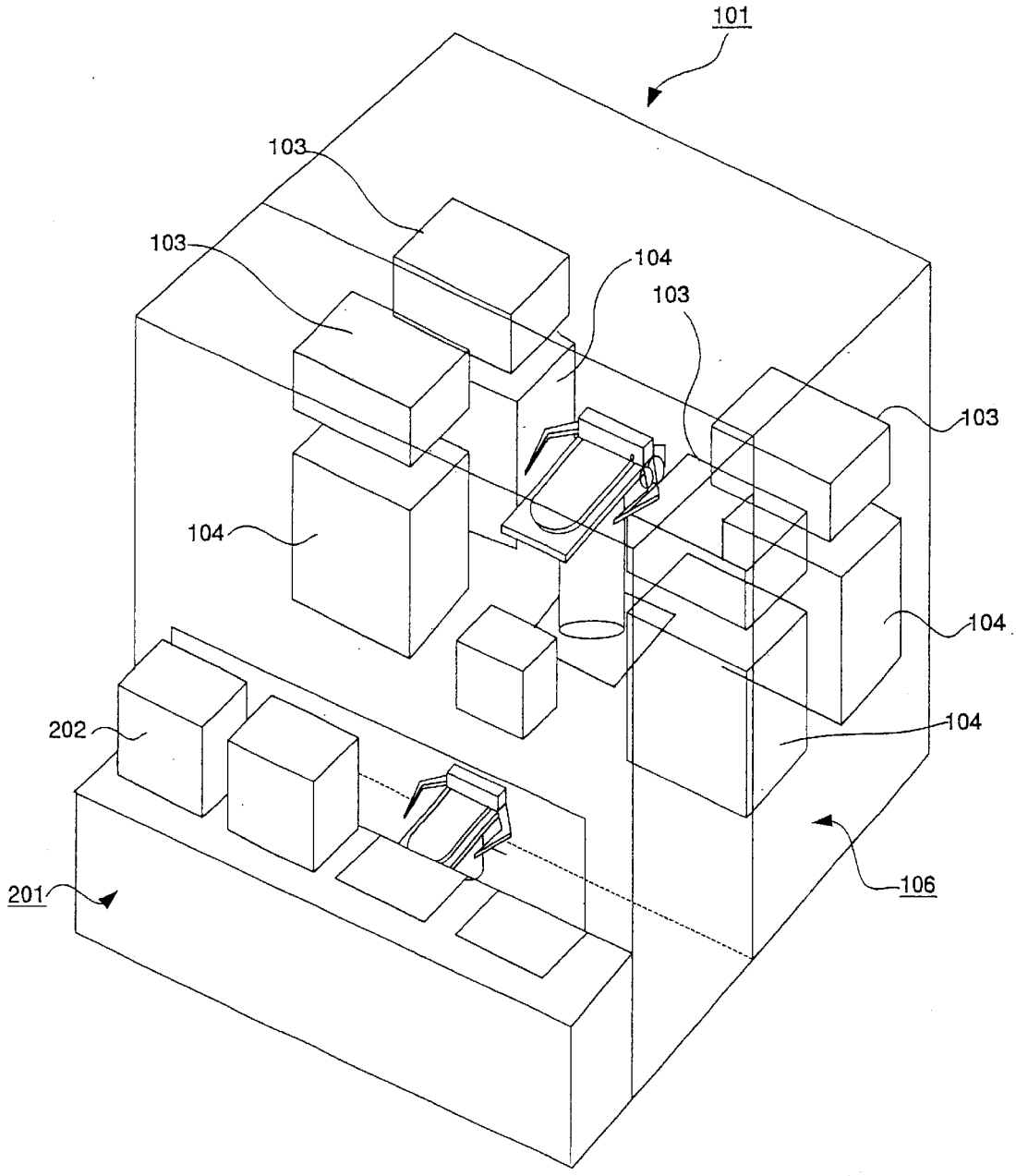
FIG. 4 illustrates a modification of a plating process system.

In the aforementioned first embodiment, the process station 106 has two plating units 104 and two washing/drying units 103. The number of the respective units is not limited to this, and any number of units may be possible, for example, the process station 106 may have three plating units 104 and three washing/drying units 103. Moreover, as illustrated in FIG. 4, the units can be stacked to form a multi-stage structure. In this case, for example, as illustrated in the figure, a structure in which four plating units 104 are provided in the lower stage and four washing/drying unit 103 are provided in the upper stage may be possible.

Furthermore, the process station 106 may have a unit for annealing in addition to the plating unit 104 and the washing/drying unit 103.

The aforementioned first embodiment explained the plating apparatus that provides plating to the semiconductor wafer as an example. However, the present invention is not limited to the plating apparatus, and can be applied to the processing apparatus that provides process to processing object with various kinds of solution.

The following will explain the structure of the plating unit 104 according to the first embodiment.

Figure 5:
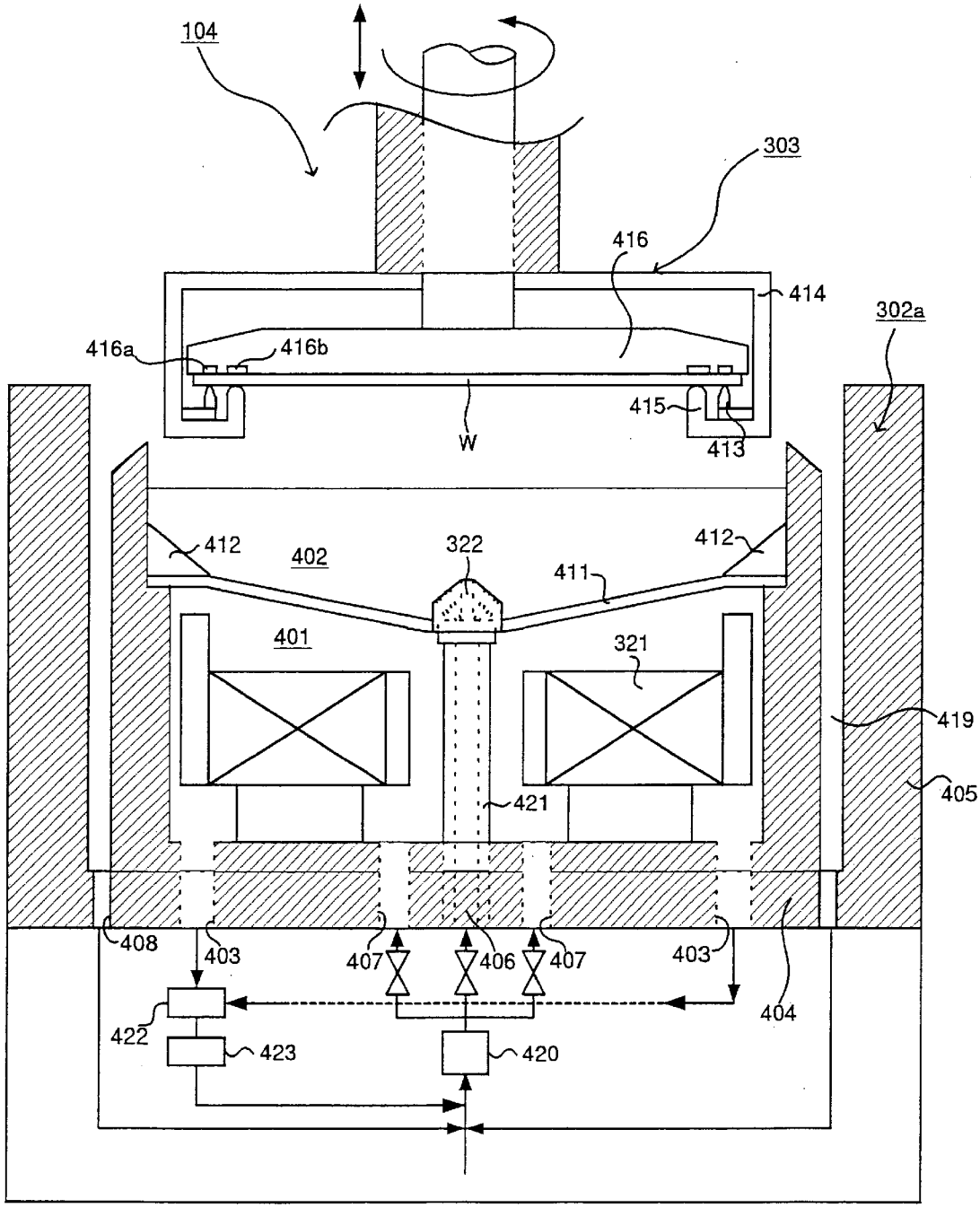
FIG. 5 illustrates the structure of a plating process unit according to the first embodiment.

FIG. 5 illustrates the structure of the main parts of the plating unit 104 shown in FIG. 3. As illustrated in FIG. 5, the plating bath 302*a* of the plating unit 104 is composed of an inner bath 404 and an outer bath 405.

In the inner bath 404, the anode electrode 321 is provided, and a diaphragm 411 is provided at the upper portion of the anode electrode 321. The diaphragm 411 divides the inner bath 404 into a first partition 401 of the lower layer and a second partition 402 of the upper layer. The diaphragm 411 is made of a resin film through which the plating solution does not pass but an electron produced by an electrolytic reaction passes. For this reason, though the plating solution of the first partition 401 and that of the second partition 402 are separated from each other, the current passes between them. On the diaphragm 411, there is provided a fin 412 that prevents the plating solution from staying at the bottom peripheral edge of the inner bath 404. The inner bath 404 is filled with the plating solution, for example, copper sulfate, up to the level exceeding the fin 412.

At the bottom of the inner bath 404, there are formed first supply ports 407 for supplying the plating solution to the first partition 404 and second discharge ports 403 for discharging the plating solution from the first partition 401. The plating solution is supplied to the first partition 401 through the first supply ports 407 by a circulation pump 420. The plating solution of the first partition 401 circulates in the first partition 401 while forming convection directing from the lower portion to the upper portion. The circulated plating solution is discharged from the first partition 401 through the first discharge ports 403.

The first discharge ports 403 are connected to a plating solution reservoir 422. The plating solution discharged from the first discharge ports 403 are once reserved in the plating solution reservoir 422. The plating solution reservoir 422 is connected to the pump 420 through a filter 423. The plating solution discharged from the first discharge ports 403 contains bubbles generated with the plating and impurities such as a by-product and the like. Accordingly, the plating solution reserved in the plating solution reservoir 422 is supplied to the line connected to the circulation pump 420 after the bubbles and impurities are removed by the filter 423.

At the bottom of the inner bath 404, there is formed a second supply port 406 for supplying the plating solution to the second partition 402. The second supply port 406 is connected to a supply pipe 421 that passes through the first partition 401, and the supply pipe 421 is connected to a nozzle section 322 that projects onto the diaphragm 411. The plating solution is supplied to the second partition 402 through the second supply port 406, supply pipe 421, and nozzle section 322. The plating solution supplied from the nozzle section 322 forms convection directing from the lower portion to the upper portion. Here, the plating solution is prevented from staying at the bottom side of the second partition 402 by the fin 412 provided at the bottom side of the second partition 402.

The outer bath 405 is provided at the outside of the inner bath 404, and a slot 419 is formed between the inner bath and the outer bath 405. At the bottom of the outer bath 405, there is formed a second discharge port 408 for discharging the plating solution flowed into the slot 419 resulting from an overflow from the inner bath 404. The second discharge port 408 is connected to the line connected to the circulation pump 420. The plating solution flowed into the slot 419 is sent to the inner bath 404 again by the circulation pump 420.

In order to control the circulation of plating solution, the flow control valve may be attached to the first discharge port 403 and second discharge port 408. Moreover, a sensor for an operation factor necessary to control the plating solution such as temperature, pressure, or concentration of plating solution, and the like may be attached thereto as required.

At the upper portion of the plating bath 302*a*, there is provided the wafer holding member 303 for holding a wafer W as an object to be plated. The wafer holding member 303 has a holding section 414 by which the wafer W is held in a state that a processing surface is placed down. The wafer holding member 303 moves down in a state that the wafer W is held, whereby dipping the wafer W in the plating solution of the plating bath 302*a*.

The holding section 414 is formed in such a way that its lower end is projected to an inner peripheral side, and a seal section 415 is provided at the end portion of the projection side. The seal section 415 is made of, for example, rubber. The seal section 415 holds the bottom surface of the wafer W, and prevents the plating solution from entering the outer peripheral side (between the seal section 415 and the holding section 414) of the seal section 415 in a state that the wafer W is held on the seal section 415.

Figure 6A:
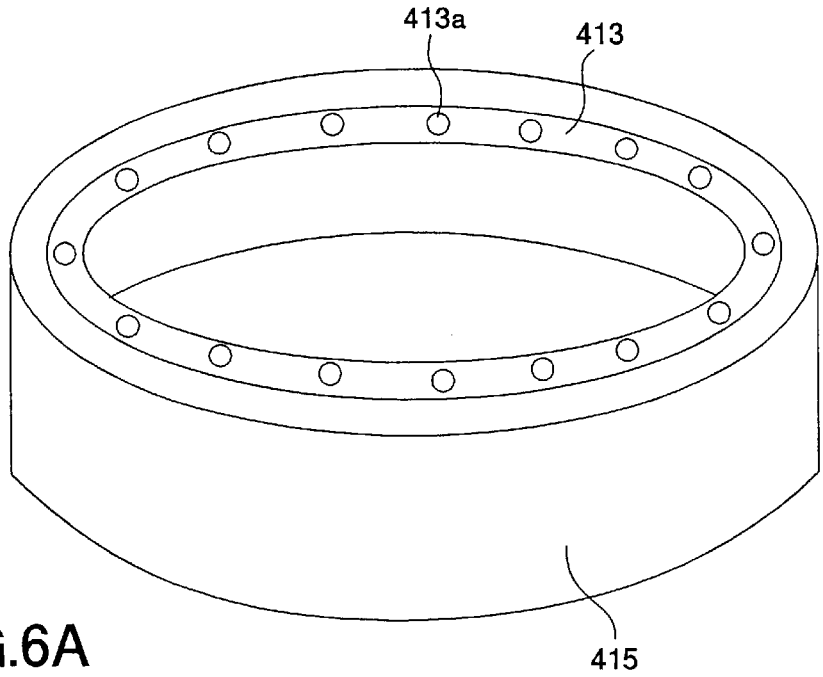
FIGS. 6A and 6B each illustrates the structure of a cathode electrode.
Figure 6B:
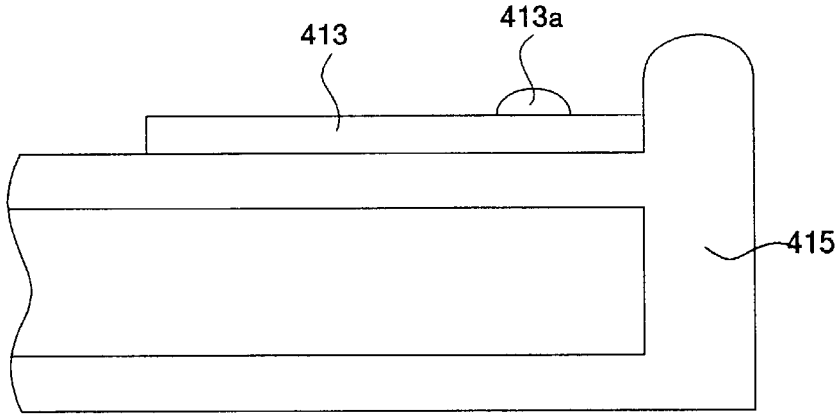

At the outer peripheral side of the seal section 415, the cathode electrode 413 is provided. The cathode electrode 413 is connected to the negative pole of the power source. An example of the cathode electrode 413 is illustrated in FIGS. 6A and 6B. FIG. 6A is a perspective view of the cathode electrode 413, and FIG. 6B is a partially sectional view of the cathode electrode 413.

As illustrated in FIG. 6A, the cathode electrode 413 is formed in a doughnut shape. As illustrated in FIG. 6B, convex contact pins 413*a* are formed on the upper surface of the cathode electrode 413. The contact pins 413*a* are arranged to be electrically connected to the wafer W in a state that the wafer W is held on the seal section 415. At the time of plating, the wafer W is applied the negative potential, and a plating layer (copper layer) is formed on the surface of the wafer W.

As illustrated in FIG. 6A, in order to increase the area of the processing surface for wafer W as much as possible, the plurality of contact pins 413*a* is arranged on circumference, which is slightly smaller than the diameter of the wafer W, e.g., circumference, which is smaller than the diameter of the wafer W by about 1 mm. The contact pins 413*a* are arranged on the circumstance of the cathode electrode 513 at regular intervals in such a way to have an angle of preferably about 10 degrees or less and more preferably about 3 degrees. Accordingly, preferably 32 or more contact pins 413*a* and more preferably about 120 contact pins 413*a* are arranged on the cathode electrode 413.

Backing to FIGS. 6A and 6B, the holding section 414 has a vacuum chuck that loads and unloads the wafer W, and a pressing tool 416. The pressing tool 416 is fit into the upper wall of the holding section 414 to be movable up and down directions. The pressing tool 416 is moved down, whereby the wafer W is pressed upwardly during plating to fix the wafer W. The pressing tool is also moved down at the time of checking connection, described below.

Figure 7A:
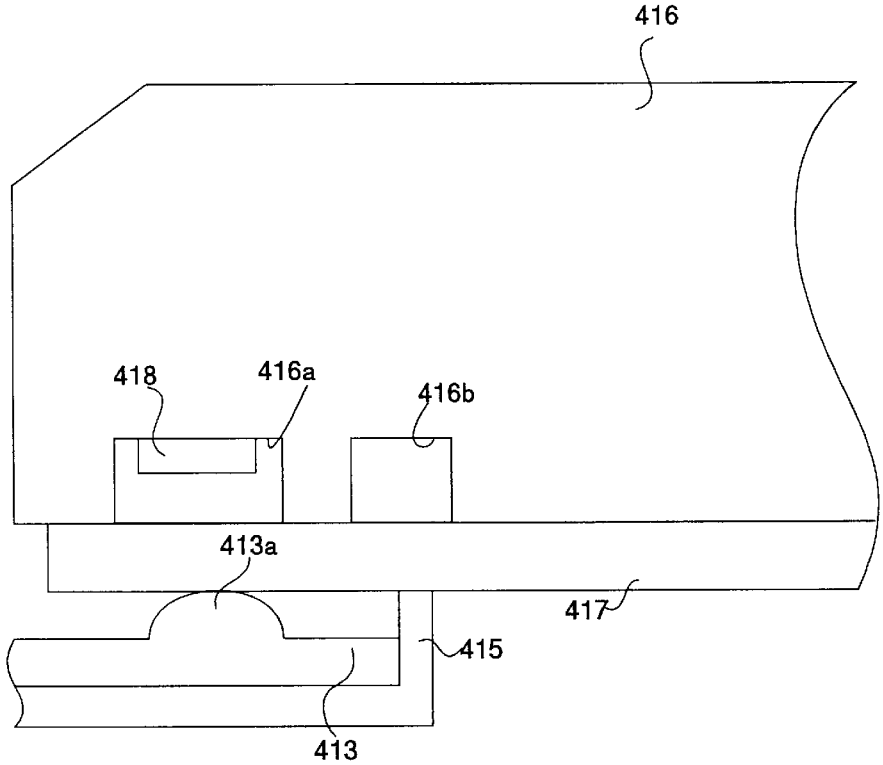
FIGS. 7A and 7B each illustrates the structure in the vicinity of a pressing tool.
Figure 7B:
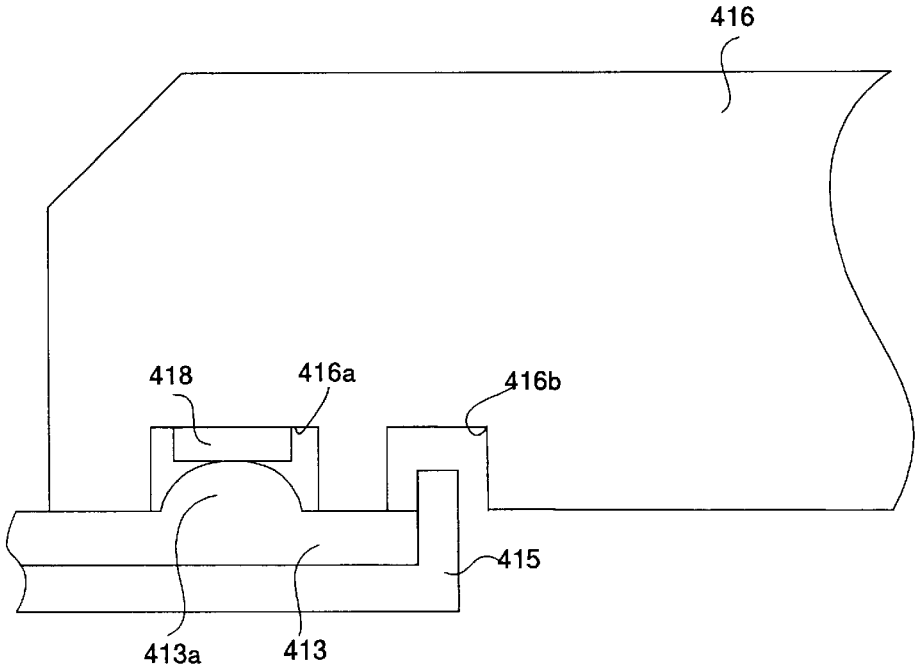

At the position which is opposite to the contact pins 413*a* of the lower surface of the pressing tool 416, a first concave portion 416*a* is formed. At the position, which is opposite to the seal section 415 of the lower surface of the pressing tool 416, a second concave portion 416*b* is formed. FIG. 7A illustrates the portion in the vicinity of the first concave portion 461*a* and second concave portion 416*b* at the time of plating. FIG. 7B illustrates the portion in the vicinity of the first concave portion 416*a* and second concave portion 416*b* at the time of checking connection.

As illustrated in FIG. 7A, a probe 418 is provided in the first concave portion 416*a*. The probe 418 is placed at the position opposite to each contact pin 413*a*. The probe 418 is positioned not to contact with the wafer W when the pressing tool 416 is at the descent position at the time of plating as illustrated in FIG. 7A. At the time of checking connection, the pressing tool 416 is at the descent position and the probe 418 contacts with the contact pins 413*a* as illustrated in FIG. 7B.

Figure 8:
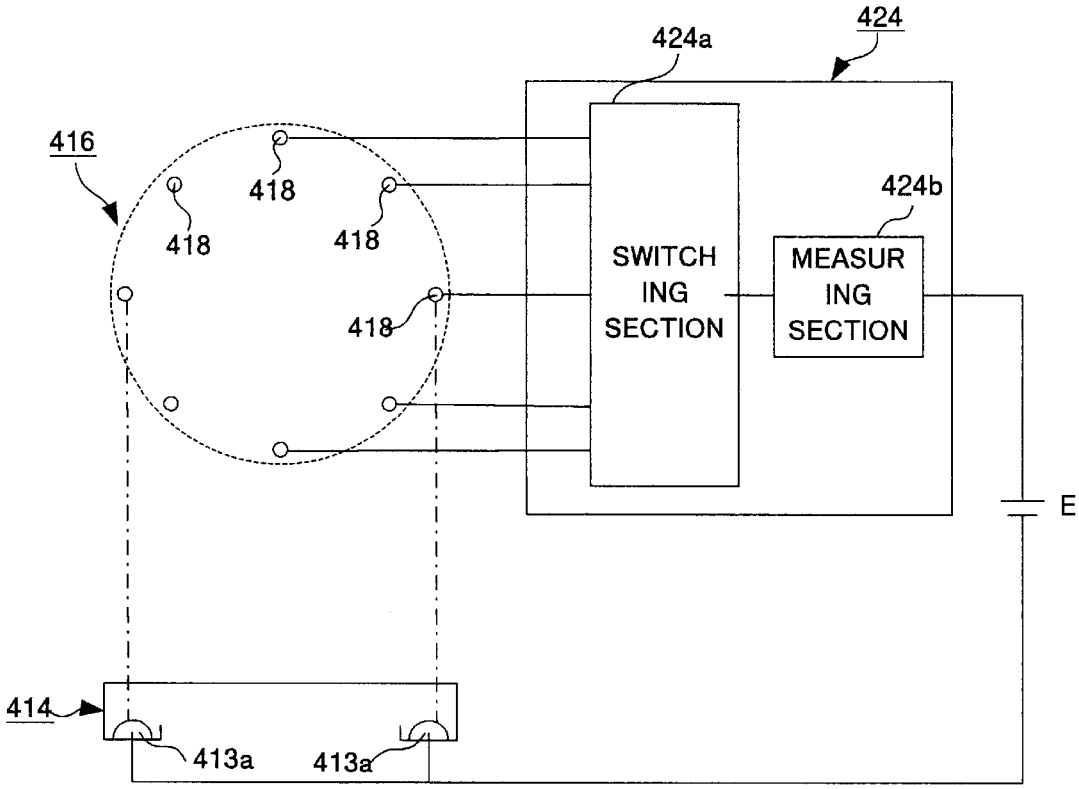
FIG. 8 is a circuit diagram of a measuring system.

The probe 418 is provided to check the contact state of the contact pin 413*a* of the cathode electrode 413. FIG. 8 shows one example of a circuit including the probes 418 and a measuring device 424. As shown in FIG. 8, the contact pins 413*a* of the cathode electrode 413 are connected to the negative pole of the power source E. While, the probes 418 are connected to the positive pole of the power source E through the measuring device 424.

The measuring device 424 comprises a selector switch 424*a* and a measuring section 424*b*. Each probe 418 is connected to the power source E through the selector 424*a*.

The selector switch 424*a* switches connection between each probe 418 and the measuring device 424*b* in order. At the time of checking connection, the pressing tool 416 is at the descent position and all contact pins 413*a* of the cathode electrode 413 come in contact with probes 418. At this time, the selector switch 424*a* connects a pair of contact pin 413*a* and probe 418, which contact with each other, to the power source E sequentially.

The measuring section 424*b* comprises a resistance measuring device and the like. The measuring section 424*b* measures a current value between a pair of contact pin 413*a* and probe 418, which are in contact with each other electrically. Here, in the case where the contact pin 413*a* and the probe 418 are in electrical contact with each other with reliability, a resistance value therebetween is 0 or an extremely small value, and a relatively large current flows. While, in the case where the plating solution, impurities, and the like are adhered to the surface of the contact pin 413*a* and the contact state of the contact pin 413*a* is poor, the resistance value becomes large, and a relatively small current flows.

The measuring device 424 is connected to the controller 318. The measuring device 424 sends obtained current value data between each contact pin 413*a* and each probe 418 to the controller 318. The controller 318 determines the contact (connection) state of each contact pin 413*a* from the current quantities.

For example, the controller 318 determines that the contact state of contact pin 413*a* is normal when the current value between the contact pin 413*a* and the corresponding probe 418 is more than a predetermined value. While, in the case where the current value is below the predetermined value, the controller 318 determines that the contact state of contact pin 413*a* is abnormal.

The controller 318 performs control of the overall apparatus such as continuation of plating or stop processing, and the like based on the determination result. This makes it possible to check the contact state of each contact pin 413*a* without fail, and to perform plating with high reliability.

An explanation will be next given of a plating method using the above-structured plating unit 104.

Figure 9A:
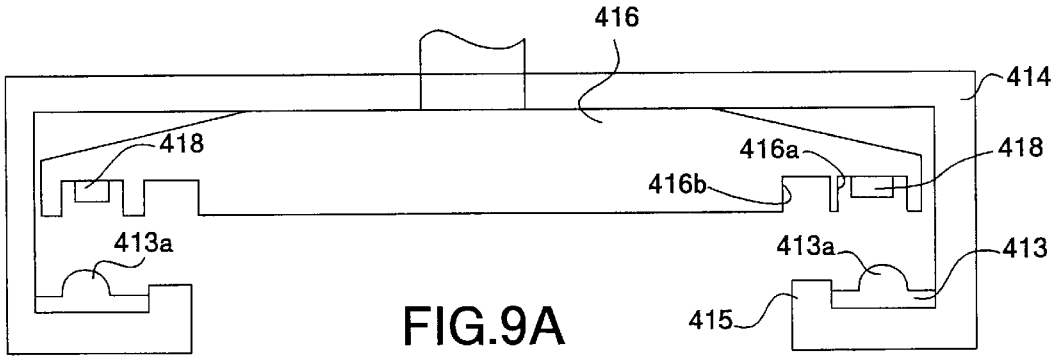
FIGS. 9A to 9D each illustrates a contact check and plating process.

First, the contact state of contact pin 413*a* of the cathode electrode 413 is checked before the wafer W is plated. As illustrated in FIG. 9A, the pressing tool 416 rises in the holding section 414. At this time, the pressing tool 416, the contact pin 413*a*, and the seal section 415 are spaced one another.

Figure 9B:
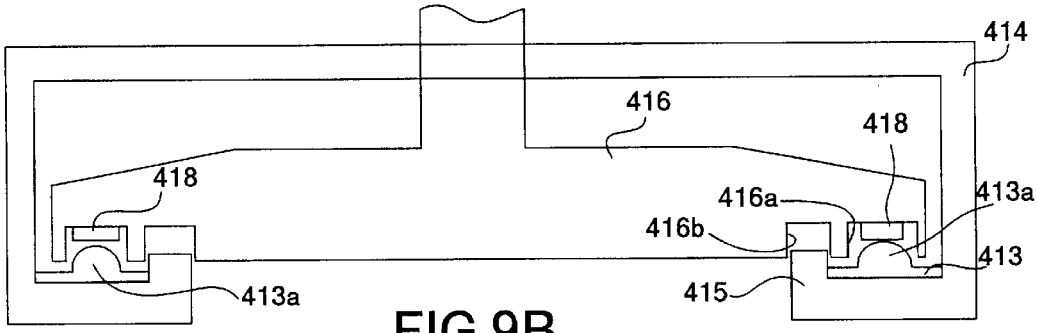

Next, as illustrated in FIG. 9B, the pressing tool 416 moves down. At the position corresponding to the contact pin 413*a* of the lower surface of the pressing tool 416, the first concave portion 416*a* is formed. At the position corresponding to the seal section 415 of the lower surface of the pressing tool 416, the second concave portion 416*b* is formed. Accordingly, when the pressing tool 416 moves down, the contact pin 413*a* is contained in the first concave portion 416*a* and the seal section 415 is contained in the second concave portion 416*b*. At this time, the probe 418 in the first concave portion 416*a* and the contact pin 413*a* are in contact with each other. In this state, the measuring device 424 measures the electrical resistance between each pair of contact pin 413*a* of the cathode electrode 413 and probe 418 sequentially.

The controller 318 determines that the contact state of contact pin 413*a* is normal when the current value between the contact pin 413*a* and the corresponding probe 418 is more than a predetermined value. While, in the case where the current value is below the predetermined value, the controller 318 determines that the contact state of contact pin 413*a* is abnormal. The controller 318 stops plating when determining that the contact state is abnormal, and continues plating when determining the contact state is normal.

Figure 9C:
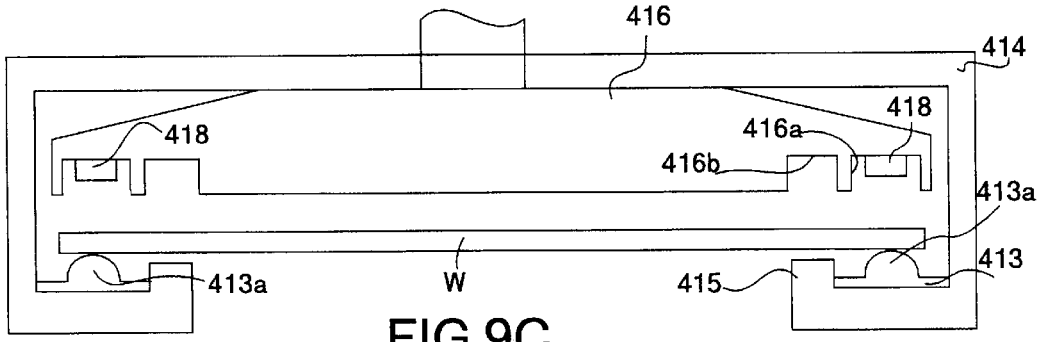

After checking contact (connection), the pressing tool 416 rises and a space is formed among the pressing tool 416, the contact pin 413*a*, and the seal section 415. Then, as illustrated in FIG. 9C, the second wafer transfer apparatus 213 loads the wafer W into the plating unit 104 through the space and mounts the wafer W on the contact pins 413*a* and the seal sections 415.

Figure 9D:
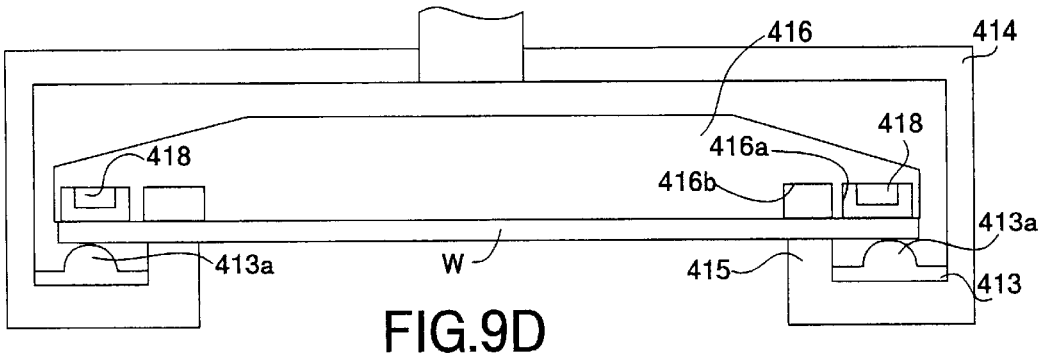

Sequentially, as illustrated in FIG. 9D, the pressing tool 416 moves down and presses the wafer W from the above. This fixes the wafer W to be adhered to the seal section 415. Next, the holding section 414 moves down as holding the state that the pressing tool 416 presses the wafer W, so that the wafer W is dipped in the plating solution to provide plating to the processing surface of the wafer W. Namely, a predetermined voltage is applied to the anode electrode 321 and the cathode electrode 413, and a plating layer (copper layer) is deposited on the processing surface of the wafer W.

When the plating is ended, the holding section 414 rises as holding the state that the pressing tool 416 presses the wafer W. After that, as illustrated in FIG. 9C, the pressing tool 416 rises. Sequentially, as illustrated in FIG. 9A, the wafer W is carried to the outer section of the plating unit 104 by the second wafer transfer apparatus 213. After carrying the wafer W, plating of a new wafer is performed after checking connection.

In the above example, the first concave portion 416*a* and the second concave portion 416*b* are formed in the pressing tool 416, and the probe 418 is provided in the first concave portion 416*a*. In a state that the wafer W is not held by the holding section 414, the pressing tool 415 is moved down such that the contact pin 413*a* are brought in contact with the probes 418. However, the present invention is not limited to this. For example, there may used a structure in which the drive mechanism is provided to make the probes 418 movable up and down without providing the first concave portion 416*a* and second concave portion 416*b*.

The above example explained the case in which the current value between the contact pin 413*a* and the probe 418 was measured for each contact pin 413*a* as an example of the method for measuring the contact state of the cathode electrode 413. However, the present invention is not limited to this. Other various methods may be used if the method is one that can detect the contact state of contact pins 413*a*. Moreover, instead of checking the contact state of all contact pins 413*a*, for example, a given contact pin 413*a* may be checked.

Figure 10:
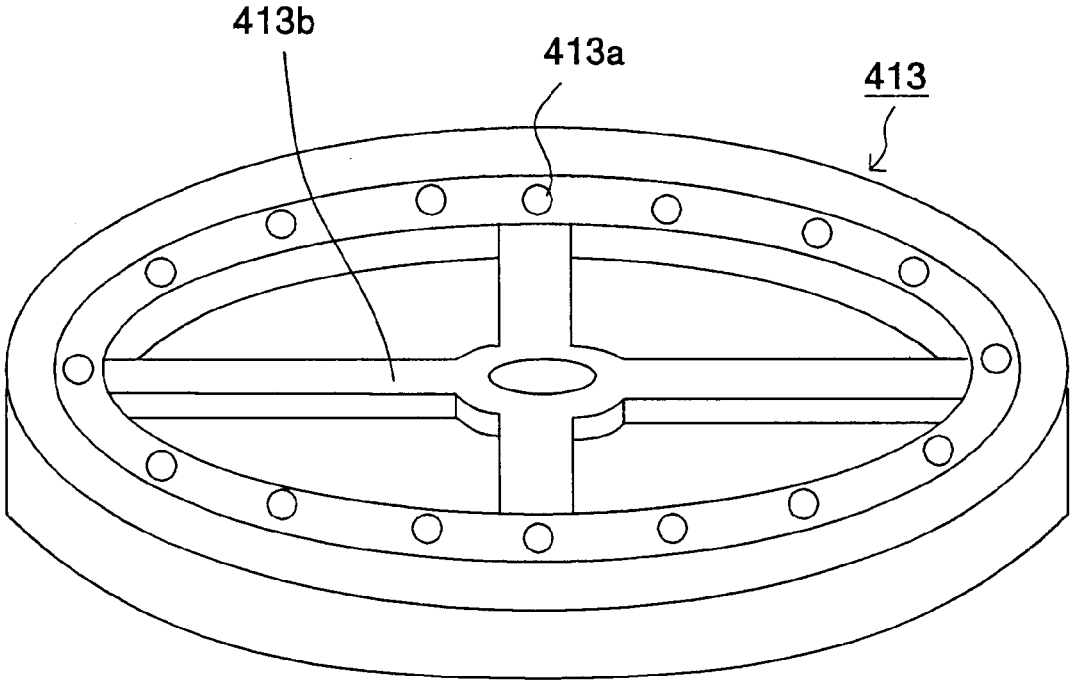
FIG. 10 illustrates a modification of a cathode electrode.

The above example explained the case using the doughnut-shaped cathode electrode 413. However, the present invention is not limited to this. For example, as illustrated in FIG. 10, the cathode electrode 413 may have a reinforcing member 413*b* at its center. In this case, it is possible to thin the cathode electrode 413.

Second Embodiment

The following will explain a plating chamber as an example regarding the processing apparatus according to the second embodiment of the present invention with reference to the drawings accompanying herewith.

The first embodiment explained the example of the multi-unit typed processing apparatus in which the respective process units were arranged in a common apparatus. The present invention, however, may be applied to the multi-chamber typed apparatus set forth below.

Figure 11:
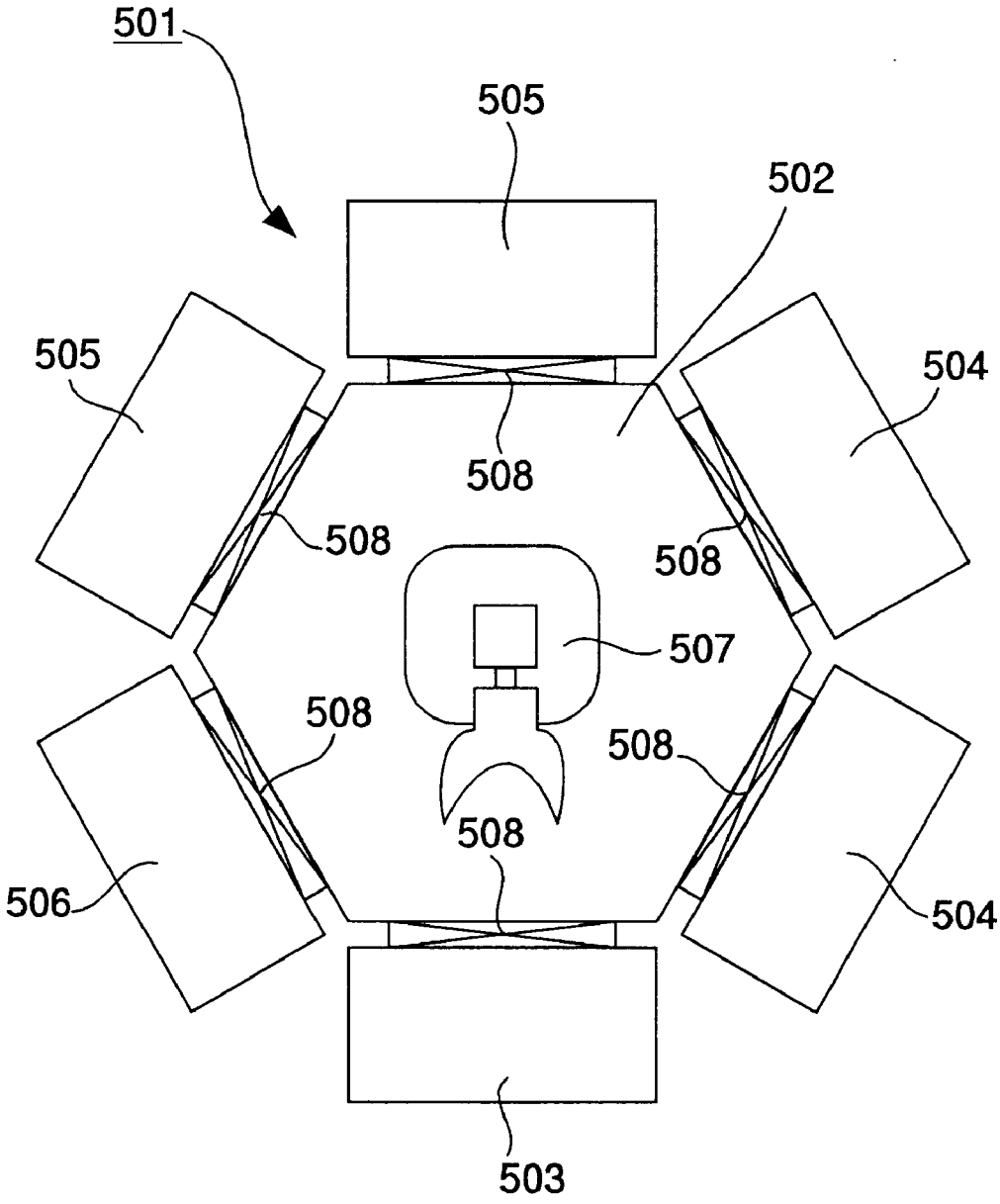
FIG. 11 illustrates the structure of a plating system according to a second embodiment.

The plating chamber according to the second embodiment is applied to, for example, a plating system 501 as illustrated on a plane in FIG. 11. The plating system 501 provides plating to the surface of the semiconductor wafer to form, e.g., a copper wiring layer.

The plating system 501 is composed of a transfer chamber 502, a load lock chamber 503, a plating chamber 504, a washing/drying chamber 505, and an anneal chamber 506. As illustrated in this figure, the plating system 501 is the so-called cluster-type multi-chamber system in which a plurality of process chambers is connected.

The transfer chamber 502 has a transfer apparatus 507. The transfer apparatus 507 performs the load/unload of wafer between the plating system 501 and the outer section, and performs the transfer of wafer W among the respective chambers of the plating system 501. The transfer chamber 502 is connected to an exhaust device, a pressure controller, and is controllable to given pressure.

The load lock chamber 503 functions as a load/unload port for wafer W of the plating system 501. In the load lock chamber 503, a cassette in which a predetermined number of unprocessed wafers W, e.g., twenty-five, are contained is loaded from the outer section. While, the cassette in which the wafers W subjected to plating are contained is unloaded from the load lock chamber 503.

The load lock chamber 503 is connected to the transfer chamber 502 through a gate 508. When the cassette is loaded/unloaded by the load lock chamber 503, the gate 580 is in a close state. This maintains the interior of the transfer chamber 502 at given pressure at the time of loading/unloading the cassette on/from the outer section.

More specifically, the load lock chamber 503 has a pump and the like, and the internal pressure becomes substantially the same as the pressure of the transfer chamber 502 after loading the cassette. In this state, the gate is opened, and the wafer W is loaded into the transfer chamber 502 from the cassette or unloaded therefrom. At the time of unloading the cassette to the outer section, the internal pressure of the load lock chamber 503 becomes substantially the same as the pressure of the outer section and the transfer of cassette is performed.

The plating chamber 504 is connected to the transfer chamber 502 through the gate 508. The wafer W unloaded from the cassette of the load lock chamber 503 is loaded into the plating chamber 504 through the gate 508. A copper seed layer is formed on the surface of the wafer W loaded to the plating system 501 by sputtering and the like. At the plating chamber 504, a copper-made wiring layer is formed on the seed layer on the surface of the wafer W by plating.

The washing/drying chamber 505 is connected to the transfer chamber 502 through the gate 508. The wafer W plated at the plating chamber 504 is transferred to the interior of the washing/drying chamber 505 through the gate 508 by the transfer apparatus 507. The washing/drying chamber 505 has an air supply device, an exhaust device and the like, and is controllable to atmosphere independently of the transfer chamber 502.

The washing/drying chamber 505 performs the washing of wafer W subjected to plating. More specifically, chemical washing for removing a plating thin film adhered on to the back surface of the wafer W and washing for the overall wafer W with pure water are performed. The washing/drying chamber 505 has a function of drying the washed wafer W, and the wafer W unloaded from the washing/drying chamber 505 is in a dry state.

The anneal chamber 506 is connected to the transfer chamber 502 through the gate 508. The wafer W washed by the washing/drying chamber 505 is transferred to the interior of the anneal chamber 506 through the gate 508. The anneal chamber 506 has an air supply device, an exhaust device and the like, and is controllable to atmosphere independently of the transfer chamber 502. The anneal chamber 506 has a heating device and the like. The wafer W is annealed by the heating device to improve a film quality of a plating thin film formed on the surface of the wafer W.

Figure 12:
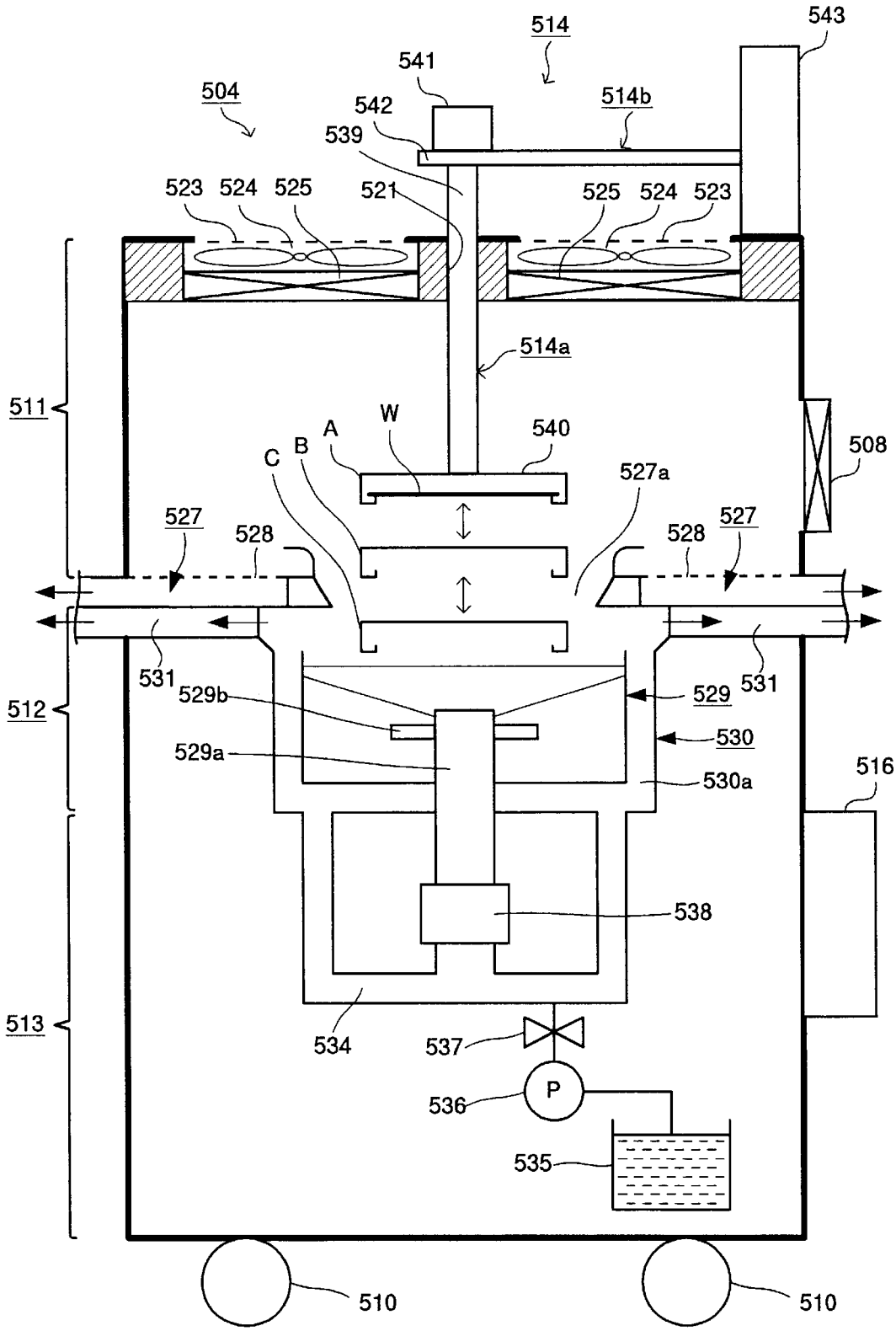
FIG. 12 illustrates the structure of a plating chamber according to the second embodiment.

As mentioned above, the plating system 501 has the respective chambers around the transfer chamber 502 having six gates 508 as illustrated in FIG. 11. Here, each chamber has the structure having casters 510 as illustrated in FIG. 12. Accordingly, each chamber having casters 510 can be easily moved to construct the plating system 501.

In the case where a malfunction occurs in the chamber, the chamber can be easily separated from the plating system 501 to amend it, or the defective chamber can be easily replaced with a preliminary chamber. Accordingly, the plating system 501 is structured to have high maintenance.

A control circuit for controlling the operation of the above-structured plating system 501 is provided to each chamber or one control circuit is provided to the plating system 501. In the case where the control circuit is provided to each of the chambers, the respective control circuits are connected to one another by a cable and the like in such a way that the operation at each chamber efficiently performed.

An explanation will be next given of the specific structure of the plating chamber 504 according to the second embodiment.

FIG. 12 is a cross-sectional view illustrating the structure of the plating chamber 504.

As illustrated in FIG. 12, the interior of the plating chamber 504 is divided into three areas, namely, a transfer section 511, a plating section 512, and a circulation section 513 vertically in order. At the outer portion of the plating chamber 504, a moving mechanism 514 for transferring the wafer W and casters 510 for moving the plating chamber 504 are provided.

The transfer section 511 is an area where the delivery of wafer W between the outer section and the transfer section is performed. At the ceiling of the transfer section 511, an opening 521 for installing the moving mechanism 514 is formed, and a part of the moving mechanism 514 is installed in the interior of the plating chamber 504 through the opening 521. The gate 508 for loading/unloading the wafer W is formed at the side wall of the transfer section 511. The gate 508 is connected to the transfer chamber 502, so that the wafer W is moved between the plating chamber 504 and the transfer chamber 502 through the gate 508.

Moreover, at the ceiling of the transfer section 511, one or a plurality of pairs of sets of an inlet 523, a fan 524 and a filter 525 is provided in order to generate air down flow in the transfer section 511 to be filled with clean air.

The inlet 523 is formed at the top plate of the plating chamber 504 and passes through outside air of the clean room. The fan 524 takes in the outside air through the inlet 523 and supplied it to the transfer section 511. The filter 525 has a dustproof filter in its interior, and removes impurities such as dust, dirt, and the like contained in the air taken by the fan 524. The filter 525 may have an organic removal filter for trapping organic materials and a chemical filter for removing chemical material ingredients.

A separator 527 for separating air in the transfer section 511 and air in the plating section 512 from each other is formed between the transfer section 511 and the plating section 512. On the upper surface of the separator 527, a plurality of holes 528 is formed, and gas in the transfer section 511 is sucked and exhausted through the holes 528. Accordingly, the separator 527 functions as a suction pipeline.

Clean air is supplied to the interior of the transfer section 511 through the filter 525, and gas in the transfer section 511 is exhausted through the holes 528 of the separator 527. For this reason, clean down-flow always exists in the transfer section 511 and the interior of the transfer section 511 is maintained clean atmosphere.

The separator 527 has an opening 527*a* for which the wafer W moves between the transfer section 511 and the plating section 512. In the vicinity of the separator 527, there is provided a washing nozzle that injects pure water into the lower surface (plated surface) of the wafer W placed at a given washing position B and cleans the surface.

The plating section 512 is an area where the wafer W is subjected to plating, and has an inner bath 529, an outer bath 530, and an exhaust pipe 531.

The inner bath 529 is a bath that reserves a plating solution such as copper sulfate solution supplied from the circulation section 513. When the inner bath 529 is filled with the plating solution, the plated surface of the wafer W placed at a given plating position C is designed in such a way as to come in contact with the solution level of the plating solution. At the bottom of the inner bath 529, there is provided an injection pipe 529*a* serving as a supply line of the plating solution from the circulation section 513. An anode electrode 529*b*, which applies a given voltage to the plating solution, is formed around the injection pipe 529*a* when plating is performed. The anode electrode 529*b* is made of, for example, copper.

The outer bath 530 is provided to collect the plating solution overflowed from the inner bath 529. More specifically, the outer bath 530 is placed with a predetermined interval from the inner bath 529 in such a way that a collecting line 530*a* is formed between the inner bath 529 and the outer bath 530. The plating solution overflowed from the inner bath 529 is collected through the collecting line 530*a* by the circulation section 513.

The exhaust pipeline 531 is formed along the separator 527, and is connected to an exhaust system. Air in the plating section 512 containing mist of the plating solution is exhausted to the outside through the exhaust pipe 531.

According to the aforementioned structure, the transfer section 511 and the plating section 512 are separated from each other by the separator 527, down flow is formed while being exhausted from the hole 528 of the separator 527, and air in the plating section 512 is exhausted from the exhaust pipeline 531 adjacent to the separator 527. This makes it possible to separate air in the transfer section 511 and air in the plating section 512 from each other without fail. This makes it possible to maintain the wafer W placed in the transfer section 511 clean without adhering the mist of plating solution.

Moreover, down flow in the transfer section 511 can prevent the mist from being scattered to the outside of the plating chamber 504.

The circulation section 513 is an area where the plating solution is circulated. The circulation section 513 has circulation pipes 532, 533, a collecting pipe 534, a tank 535, a pump 536, a valve 537, and an injection pump 538.

The collecting pipe 534 is connected to the collecting line 530*a* formed between the inner bath 529 and the outer bath 530, and collects the plating solution overflowed from the inner bath 529 and supplies it to the injection pump 538.

The tank 535 reserves a supplementary plating solution with a given concentration. The supplementary plating solution is supplied to the collecting pipe 534 through the supply pump 536 and the valve 537. It is noted that the quantity of plating solution to be supplied is set to the quantity that is obtained beforehand by an experiment such that concentration of the plating solution in the inner bath 529 is constant.

The injection pump 538 is connected to an injection pipe 529*a*, and supplies the collected plating solution, which is supplied through the collecting pipe 534, and the supplementary plating solution to the inner bath 511 through the injection pipe 529*a*. This makes it possible to use the plating solution efficiently and to maintain concentration of the plating solution constant.

The moving mechanism 514 is composed of a rotation mechanism 514*a* and an elevation mechanism 514*b*.

The rotation mechanism 514*a* comprises a rotation shaft 539 that passes through the opening 521, a holding section 540, which is placed at the tip of the rotation shaft 539 and which holds the wafer W, and a rotation motor 541 that rotates the holding section 540. Here, the holding section 540 is connected to the power source and is structured in such a way that a given negative voltage can be applied to the platen surface of the wafer W.

While, the elevation mechanism 514*b* comprises a support shaft 542 that supports the rotation shaft 539, and an elevation motor 543, which is placed at the outer section of the plating chamber 504 and which elevates the support shaft 542. The elevation mechanism 514*b* moves the rotation shaft 539 up and down using the elevation motor 543 to place the holding section 540 (or wafer W) at a given position. More specifically, the elevation mechanism 514*b* places the holding section 540 at a delivery position A where the delivery of wafer W is performed between the outer section and the elevation mechanism 514*b*, a washing position B where the plated surface of wafer W is washed, and a plating position C where the wafer W is subjected to plating, respectively. The rotation mechanism 514*a* rotates the wafer W to remove extra water adhered to the wafer W after plating. In order to keep air in the transfer section 511 clean, the rotation mechanism 514*a* rotates the wafer W between the washing position B and the plating position C.

Thus, since the rotation motor 541 and the elevation motor 543 are provided at the outer section of the plating chamber 504. This makes it possible to prevent particles generated by the operation of the motor from being adhered onto the wafer W.

In the case where the control circuit for controlling the operation of the plating system 501 is provided to each chamber, the plating chamber 504 has the control section 516 as illustrated in FIG. 12. The control section 516 controls the overall operation of the plating chamber 504 relating to the plating.

An explanation will be next given of the operation of the above-structured plating chamber 504.

It is noted that the operation of the plating system 501 is controlled by the control circuits (including control section 516) though it is omitted in the following explanation.

Before starting the wafer processing, pressure, temperature, and the like of each chamber are set to predetermined values, respectively.

At this time, the plating chamber 504 reserves the plating solution with given concentration in the inner bath 529, and the internal air is divided at the separator 527 as a boundary. More specifically, the supply pipe 536 of the plating chamber 504 sucks the plating solution with given concentration from the tank 535 and supplies it to the collecting pipe 534 through the valve 537. Then, the injection pump 538 supplies the plating solution supplied to the collecting pipe 534 to the inner both 529 through the injection pipe 529*a*, so that the inner both 529 is filled with the plating solution with given plating solution. The fan 524 of the plating chamber 504 takes in outside air through the inlet 523. The outside air by the fan 524 is supplied to the transfer section 511 through the filter 525 and exhausted from the separator 527. This generates clean down flow in the transfer section 511. On the other hand, air in the plating section 512 is supplied to the exhaust system through the exhaust pipe 531 and exhausted to the outer section. In this way, the plating solution with given concentration is reserved in the inner bath 529 and air in the plating chamber 504 is divided at the separator 527 as a boundary.

After pressure of each chamber is thus set to a predetermined value, the cassette is loaded onto the load lock chamber 503. In the cassette, the wafer W having the seed layer for plating formed is contained. The internal pressure of the load lock chamber 503 to which the cassette is loaded is substantially the same as that of the transfer chamber 502, thereafter the gate 508 that isolates the transfer chamber 502 is opened.

The transfer device 507 of the transfer chamber 502 extracts the wafer W from the cassette of the load lock chamber 503 and loads it onto the plating chamber 504. More specifically, the transfer device 507 loads the wafer W through the gate 508 of the plating chamber 504 and sets the wafer W at the holding section 540 placed at the delivery position A in a state that the processing surface is placed down.

After the wafer W is set at the holding section 540, the gate 508 is closed, and the elevation mechanism 514*b* moves down the holding section 540, which holds the wafer W, to the washing position B by the elevation motor 543. After that, the elevation mechanism 514*b* moves down the holding section 540 to the plating position C by the elevation motor 543.

When the holding section 540 is placed at the plating position C and the plated surface of the wafer W comes in contact with the solution level of the plating solution, the holding section 540 applies a given voltage to the wafer W, and the anode electrode 529*b* applies a given voltage to the plating solution. More specifically, the holding section 540 applies the negative voltage to a seed layer and the anode electrode 529*b* applies the positive voltage to the plating solution. This forms the plated layer on the seed layer of the surface of the wafer W.

After the plating, when the holding section 540 is placed at the washing position B, pure water is injected to the plated surface of the wafer W from a washing nozzle to wash the processed surface of the wafer W The elevation mechanism 514*b* moves up the holding section 540 to detach the wafer W from the plating solution. It is noted that the position of the holding section 540 is placed between the washing position B and the plating position C in order to keep air in the transfer section 511 clean. In this state, the rotation mechanism 514*a* rotates the wafer W by the rotation motor 514 to remove extra water adhered to the wafer W.

Next, when the elevation mechanism 514*b* moves up the holding section 540 to the delivery position A, the gate 508 is opened and the wafer W is loaded to the transfer device 507 of the transfer chamber 502.

The wafer W unloaded from the plating chamber 504 is loaded to the washing/drying chamber 505 and is subjected to washing. More specifically, a copper thin film adhered onto the back surface of the wafer W is removed with chemicals and the entirety of the wafer W is washed with pure water. After washing at the washing/drying chamber 505, the wafer W is loaded to the anneal chamber 506 and is subjected to annealing. Whereby, a conductive layer formed by plating is uniformed in the crystalline grain size and the direction.

After annealing, the wafer W is loaded in the cassette of the load lock chamber 503 again by the transfer device 507 of the transfer chamber 502.

When the process of a predetermined number of wafers W contained in the cassette is ended, the gate 508 is closed and the internal pressure of the load lock chamber 503 becomes substantially the same as that of the outer section. In this state, the load lock chamber 503 is opened to the outer section. After that, the cassette in which the plated wafer W is contained is unloaded therefrom and processing by the plating system 501 is ended.

As explained above, the plating chamber 504 controls air in the transfer section 511, air in the plating section 512, and air in the circulation section 513 separately. This makes it possible to prevent air containing the mist of plating solution from entering the transfer section 511 and to maintain air in the transfer section 511. For this reason, even if the wafer is plated with copper that is easily contaminated, the wafer W can be prevented from being contaminated. Moreover, the rotation motor 541 of the moving mechanism 514 and the elevation motor 543 are provided at the outer section of the plating chamber 504. This makes it possible to prevent particles generated by the rotation of the motor from being adhered onto the wafer W. As a result, high yield and high reliability can be obtained.

It is needless to say that the structure of the plating apparatus described in the first embodiment can be applied to the plating chamber 504 shown in the second embodiment. Namely, it is possible to apply the method for checking connection of the plating jig as shown in the first embodiment to the plating chamber 504 shown in the second embodiment.

Figure 14:
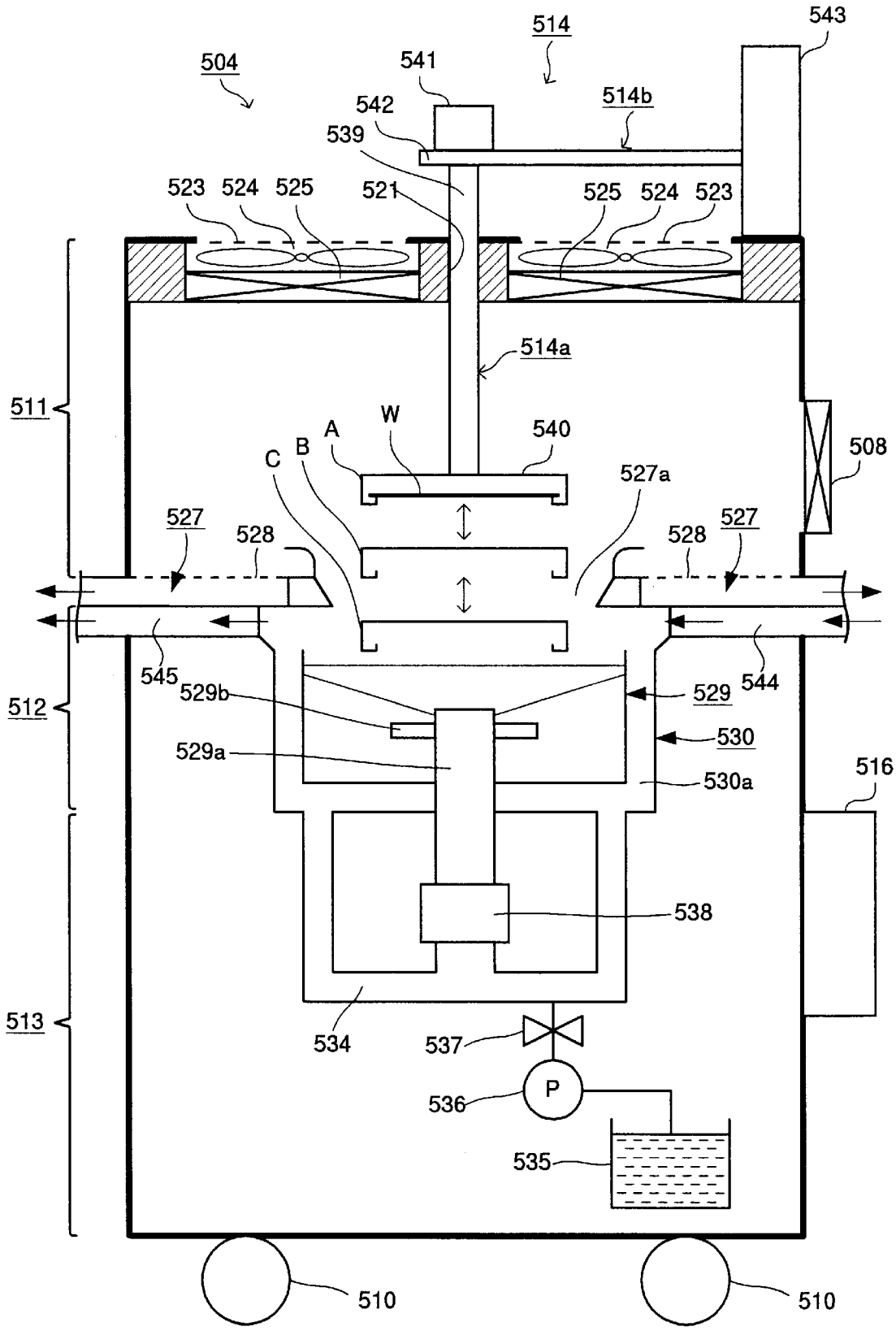
FIG. 14 illustrates a modification of the plating chamber.

In the second embodiment, though the number of plating chamber 504 and that of the washing/drying unit 505 are two, respectively, the present invention is not limited to this. The kinds of chambers that structure the plating system 501 and the number of chambers may be arbitrarily set. The above embodiments showed the example in which the present invention was applied to the plating chamber 504 forming the cluster-type plating system 501. The present invention is not limited to this. For example, the present invention may be applied to the unit-type system as illustrated in FIG. 1 or FIG. 14.

Figure 13:
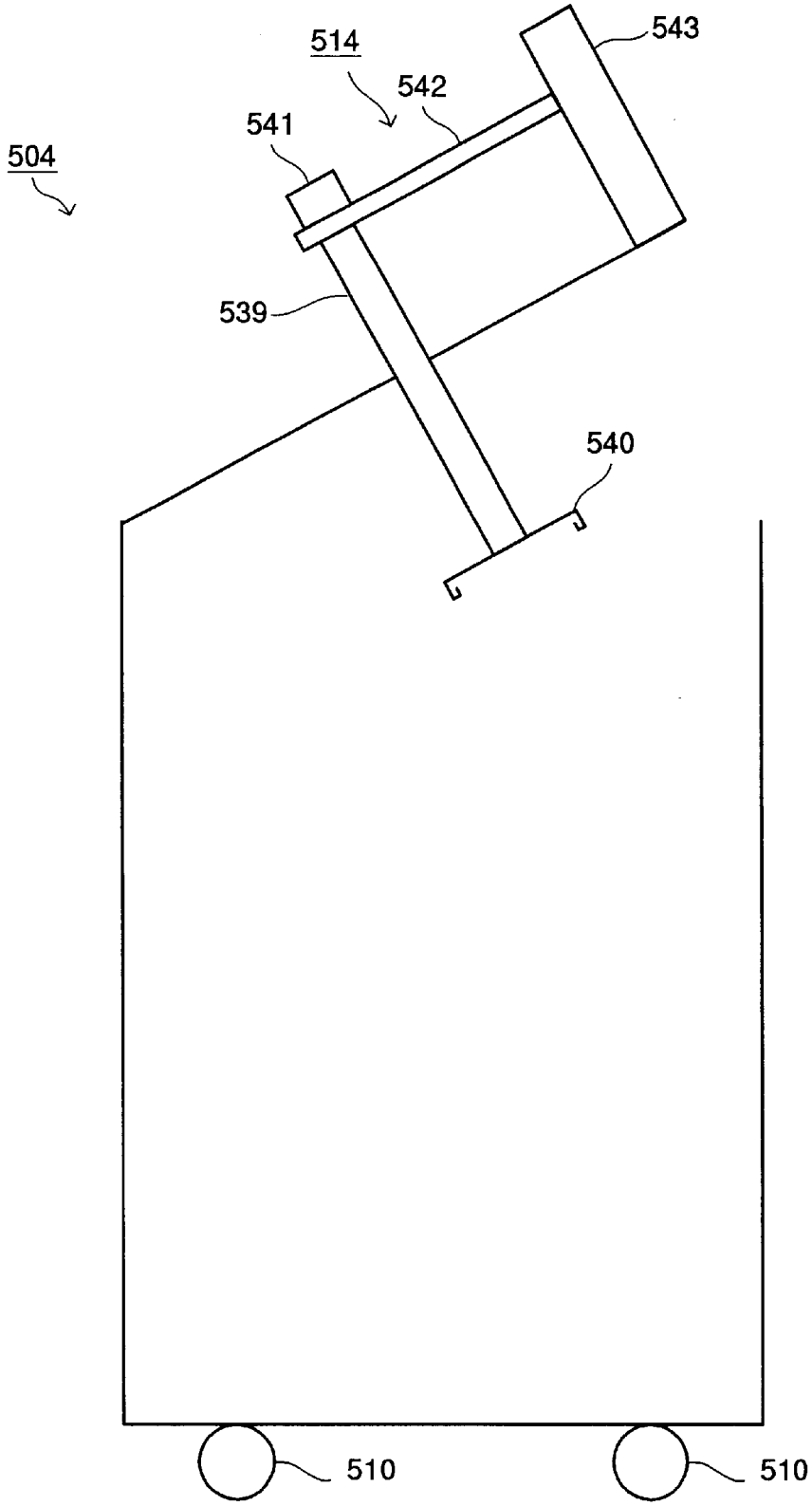
FIG. 13 illustrates a modification of the plating chamber.

The ceiling of the plating chamber 504 may be openable and closeable as illustrated in FIG. 13. This makes it possible to easily maintain the plating chamber 504. At the ceiling and the side wall of the plating chamber 504, there may be formed a plurality of doors for maintaining the piping for circulating the plating solution separately.

In place of the exhaust pipe 531, an air curtain may be provided. For example, as illustrated in FIG. 13, there are provided an injection port 544 for blowing clean air onto the plane and an inlet 545, which is placed at the position opposite to the inlet 545, for sucking air blown from the injection port 544. Then, a compressor for generating clean air to be injected is connected to the injection port 544, and air, which is sucked by connecting the exhaust pump to the inlet 545, is exhausted to the outer section. This also makes it possible to prevent air containing mist of the plating solution existing in the plating section 512 from entering the transfer section 511 and to maintain the wafer clean.

The method in which the interior is divided into the plurality of areas and air in each area is controlled independently can be applied to not only the plating chamber but also the processing chamber where gas and particles that exert an adverse influence upon the wafer W at the time of providing predetermined processing to the wafer W.

The aforementioned first and second embodiments explained the case, as an example, where processing was provided to the semiconductor wafer. However, the processing object is not limited to the wafer W, and a glass substrate for LCD (Liquid Crystal Display) may be used.

Various embodiments and changes may be made thereunto without departing from the broad spirit and scope of the invention. The above-described embodiments intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Applications Nos. 2000-133454 filed on May 2, 2000, 2000-135207 filed on May 8, 2000, and 2000-135227 filed on May 8, 2000, and including specification, claims, drawings and summary. The disclosure of the above Japanese patent Application is incorporated herein by reference in its entirety.

What is claimed is:

1. A processing apparatus comprising:

a process solution bath having a first electrode in its interior and containing a process solution;

a holding tool which holds a processing object to dip said processing object in said process solution;

a pressing tool being provided in the interior of said holding tool to be movable up and down and moving down to press said processing object to be fixed when said holding tool holds said processing object; and a second electrode, provided in said holding tool, which contacts electrically with said processing object held by said holding tool, wherein said pressing tool comprises a third electrode, which is provided at a position opposite to said second electrode, and which comes in electrical contact with said second electrode when said holding member moves down in a state that no processing object is held, and a measuring device for detecting a contact state between said second electrode and said third electrode.

2. The processing apparatus according to claim 1, wherein said measuring device measures a current flowing between said second electrode and said third electrode to measure a resistance value between said second electrode and said third electrode.

3. The processing apparatus according to claim 1, wherein the number of second electrodes provided in said holding tool is more than one, and said measuring device has a switching section which switches connection between said plurality of second electrodes and said third electrode for each second electrode.

4. The processing apparatus according to claim 1, wherein said second electrode has a convex shape, said pressing tool has a concave portion at a position opposite to said second electrode, and said third electrode is contained in said concave portion.

5. The processing apparatus according to claim 1, wherein said process solution is a plating solution, and said processing object is subjected to plating.

6. The processing apparatus according to claim 5, wherein said plating forms a film, made of copper, on a processing surface of said processing object.

7. A processing system including:

a transfer device which transfers a processing object; and a processing apparatus which provides predetermined processing to the processing object transferred by said transferring device;

said processing apparatus comprising:

a process solution bath having a first electrode in its interior and containing a process solution;

a holding tool which holds a processing object to dip said processing object in said process solution;

a pressing tool being provided in the interior of said holding tool to be movable up and down being moving down to press said processing object to be fixed when said holding tool holds said processing object; and a second electrode, provided in said holding tool, which contacts electrically with said processing object held by said holding tool, wherein said pressing tool comprises third electrodes, which are provided at a position opposite to said second electrode, and which comes in electrical contact with said second electrode when said holding member moves down in a state that no processing object is held, and a measuring device for detecting a contact state between said second electrode and said third electrodes.

* * * * *